United States Patent [19]

Kondo et al.

[11] 4,395,611

[45] Jul. 26, 1983

[54] ILLUMINATED PUSH-BUTTON SWITCH

[75] Inventors: Shiro Kondo; Yasuo Takii, both of Furukawa, Japan

[73] Assignee: Alps Electric Co., Ltd., Tokyo, Japan

[21] Appl. No.: 305,197

[22] Filed: Sep. 24, 1981

[30] Foreign Application Priority Data

Sep. 25, 1980 [JP] Japan ..... 55-133307
Oct. 24, 1980 [JP] Japan ..... 55-151987[U]

[51] Int. Cl.[3] ..... H01H 9/16
[52] U.S. Cl. ..... 200/314; 200/311
[58] Field of Search ..... 200/311, 314, 309, 310, 200/313, 312

[56] References Cited

U.S. PATENT DOCUMENTS

| | | | |
|---|---|---|---|
| 3,601,567 | 8/1971 | Shah | 200/314 |
| 3,895,204 | 7/1975 | Lewis | 200/311 X |
| 4,259,559 | 3/1981 | Kondo et al. | 200/311 |
| 4,277,665 | 7/1981 | Kondo et al. | 200/314 |
| 4,280,031 | 7/1981 | Kondo et al. | 200/314 |

*Primary Examiner*—John W. Shepperd
*Assistant Examiner*—Renee S. Kidorf
*Attorney, Agent, or Firm*—Guy W. Shoup; Gerard F. Dunne

[57] ABSTRACT

An illuminated push-button switch which has the functions of both the optical display and the mechanical display, and which produces a plurality of displays simultaneously, the displays being easily recognizable.

4 Claims, 13 Drawing Figures

Fig.1
PRIOR ART
Fig.1(A)
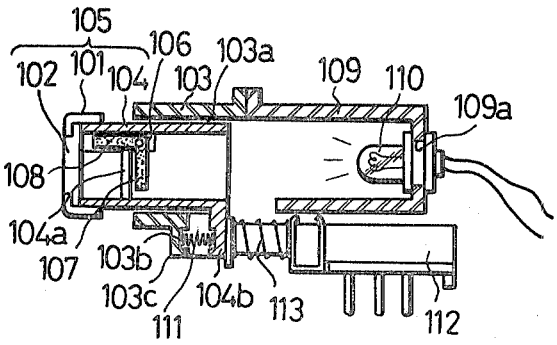
Fig.1(B)
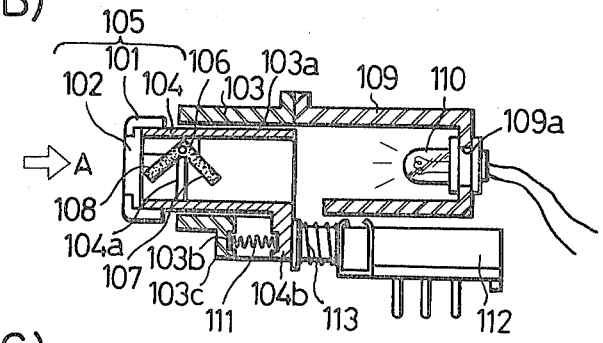
Fig.1(C)
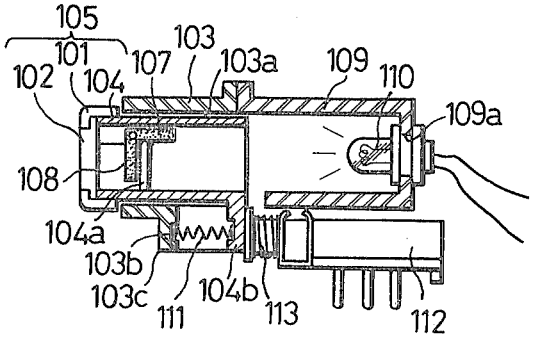
Fig.2
PRIOR ART
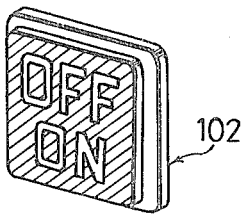

ILLUMINATED PUSH-BUTTON SWITCH

BACKGROUND OF THE INVENTION

1. Field of the Invention

The present invention relates to an illuminated push-button switch, and more specifically to an illuminated push-button switch which is illuminated at all times to indicate its location.

2. Description of the Prior Art

In conventional illuminated push-button switches, the lamp accommodated therein is typically turned on only when the push button is depressed. Therefore, when it is attempted to manipulate the push buttons in a dark place such as in an automobile at night, it is very difficult to find where the push buttons are located.

To eliminate the above defect, a variety of types of illuminated push-button switches have been proposed.

FIG. 1 is a section view illustrating a major portion of a known illuminated push-button switch such as that described in U.S. Pat. No 4,277,665, in which reference numeral 101 denotes a cap made of a synthetic resin, 102 denotes a display board made of a light-transmitting material. As shown in FIG. 2, for example, the display board 102 bears characters ON and OFF in colors complementary to each other, e.g. bluish green for ON, and red for OFF, with the remaining areas painted black. Reference numeral 103 denotes a front plate having a through hole 103*a* and a notched portion 103*c* in a side portion thereof, the notched portion 103*c* having a recess 103*b*. Reference numeral 104 denotes an operation member containing two sets of narrow tongue pieces 104*a*, 104*a* that are formed so as not to interrupt the transmission of light, and further having an operation arm 104*b* which protrudes from the side wall. The cap 101, display board 102 and operation member 104 are assembled together to form a push button 105. Reference numeral 106 denotes a rotary member consisting of two plates 107, 108 assembled at right angles to each other and which are rotatably supported by the front plate 103. Reference numeral 109 denotes a cover having a lamp 110 as a light source fitted to a hole 109*a* at a rear portion thereof. The cover 109 is attached to the front plate 103 by a screw. Reference numeral 111 designates a coil spring which is accommodated in the notched portion 103*c* of the front plate 103 and which powers the operation arm 104*b* of the operation member 104. The coil spring 111 has a resilient force that is smaller than the resilient force of a coil spring 113 which works to return a switch 112 that is provided with a self-locking mechanism.

Next, the operation of the thus constructed conventional illuminated push-button switch is described below.

FIG. 1(A) illustrates the case in which the push button has not been depressed. The light of lamp 110 passes through the red rotary plate 107 so red light reaches the display board 102. However, since the character ON is bluish green, the red light cannot pass therethrough and the character ON appears black. In this case, since the background is painted black, the character ON is not discernible. The character OFF, however, is red, so the red light can pass through and the character OFF is displayed in red on the display board 102.

When the push button 105 is depressed in the direction of arrow A as shown in FIG. 1(B), the tongue piece 104*a* of the operation member 104 comes into contact with the rotary plate 107 of the rotary member 106 that is supported by the front plate 103, whereby the rotary member 106 is rotated such that the bluish-green plate 108 is positioned in the path of the light from lamp 110 as shown in FIG. 1(C). At the same time, the operation arm 104*b* comes into contact with the switch 112 and the operation rod of switch 112 is depressed to actuate switch 112, which will be locked in position by a locking mechanism (not shown). Under this condition, the light of the lamp 110 passes through the bluish green plate 108; and bluish green light reaches the display board 102. However, the red character OFF does not pass bluish green light and appears black, and so is not indiscernable against the black background. On the other hand, the bluish green character ON passes the bluish green light and is displayed in bluish green on the display board.

If the push button 105 is depressed again, the switch 112 is liberated from the locked state, the rotary member 106 is rotated by the tongue piece 104*a* of the operation member 104, and the switch is actuated to return to the state of FIG. 1(A).

According to the above-mentioned conventional switch in which rotary plates having two complementary colors are interposed between the light source and the display board which displays the characters or symbols by relying upon the two complementary colors, it was possible to produce only a simple display such as ON and OFF. It was not possible to display the name of a device that is to be controlled by the switch, leaving much room for improvement.

SUMMARY OF THE INVENTION

The object of the present invention is to eliminate the above-mentioned defects inherent in the conventional devices. According to the present invention, therefore, there is provided an illuminated push-button switch which has both an optical display function and a mechanical display function, which gives a plurality of displays simultaneously, and which produces a display that can be accurately and easily recognized.

BRIEF DESCRIPTION OF THE DRAWINGS

FIGS. 1(A), 1(B) and 1(C) are section views illustrating a major portion of a conventional illuminated push-button switch;

FIG. 2 is a view showing a conventional display board thereof;

DESCRIPTION OF THE PREFERRED EMBODIMENTS

Figure 3:
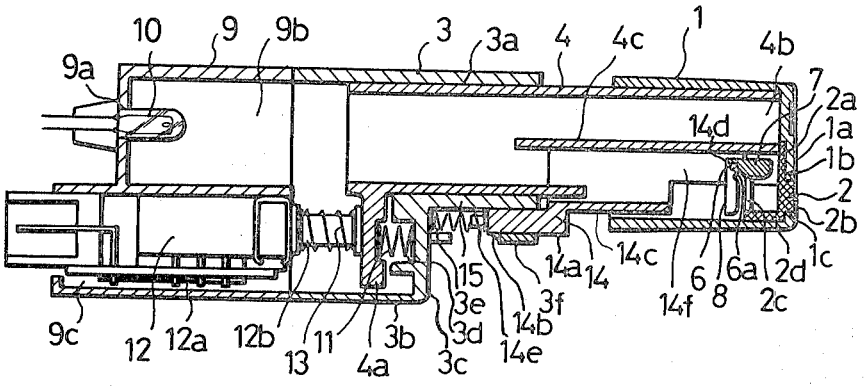
FIG. 3 is a section view showing a major portion of an embodiment of the present invention.

An embodiment of the invention will be explained below with reference to FIG. 3.

Reference numeral 1 denotes a light-transmitting cap made of a synthetic resin. In the lower portion of the outer surface 1a of the cap 1 is formed a through hole 1c, and in the inner side of the outer surface 1a is formed a recessed portion 1b extending upwardly from the through hole 1c. Reference numeral 2 denotes a display plate made of a light-transmitting material which includes a flat portion 2a fitted within the recessed portion 1b formed in the outer surface 1a of the cap 1, a protruded display portion 2b is fitted within the through hole 1c, a support portion 2d which runs along the lower wall of the cap 1 and which extends at a right angle from the flat portion 2a, and a tongue piece 2c which extends upwardly from the end portion of the support portion 2d.

Figure 4:
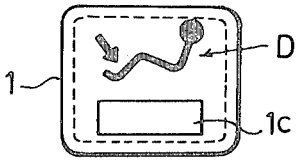
FIG. 4 is a front view of a display board thereof.

The tongue piece 2c comes into contact with and rotates the rotary plates 7, 8 of a rotary member 6 that will be described below. The distance between the tongue piece 2c and the flat portion 2a is greater than the radius of rotation of the rotary plate 7. Further, the function and the kind of display of device are shown in FIG. 4. Reference numeral 3 denotes a housing member having a rectangular opening 3a and a projection 3b which extends downwardly. In the stepped portion 3c of the projection 3b are formed recessed portions 3d and 3e on the inner and outer sides thereof. The housing member 3 includes an engaging piece 3f adapted to extend beneath an arm 14 that will be described below. Reference numeral 4 denotes a rectangular operation member which penetrates through the opening 3a of the housing member 3 and has the cap 1 fitted thereto. An operation arm 4a protrudes from the lower wall of the operation member 4 to oppose the stepped portion 3c. Further, a separator wall 4c extends through the middle region of the operation member 4 to divide the opening portion 4b. Moreover, the lower wall of the operation member 4 is removed up to its middle point on the side where the operation arm 4a is protruded to provide an opening 4b' opposing the separator wall 4c. Reference numeral 6 denotes a rotary member consisting of rotary plates 7 and 8. The rotary plates 7, 8 are assembled in an L-shape at right angles relative to each other, and a support shaft 6a extends from opposite sides of the junction of plates 7 and 8. The rotary plate 7 is made of a light-transmitting material and the rotary plate 8 is made of a material which does not permit the transmission of light. Reference numeral 9 denotes a cover equipped with an opening 9b communicating with the opening 3a of the housing member 3, and a switch-mounting hole 9c which is opposed to the projection 3b. In the rear of the opening 9b is formed a hole 9a for mounting a lamp 10 that serves as a source of light. The cover 9 and the housing member 3 are fitted together by screws or by suitable means (not shown) such as engaging portions to snap them together. Reference numeral 11 denotes a coil spring one end of which is inserted in the recessed portion 3d in the stepped portion 3c of the housing member 3, and the another end of which is fitted to the operation arm 4a of the operation member 4. Therefore, the operation member 4 is urged at all times in one direction to prevent it from rattling. The resilient force of the coil spring 11 is smaller than the resilient force of a spring 13 for returning the switch 12 mounted in the chamber 9c. The push-button switch 12 is equipped with a self-locking mechanism. Reference numeral 14 denotes an arm having an engaging portion 14a which engages with the engaging piece 3f that is provided in the housing member 3, and a bottom plate 14c is provided for covering the opening portion 4b' of the operation member 4, the surfaces of the engaging portion 14a and the side plate 14c being slightly deviated in a stepped manner. A stopper 14b is provided at the lower portion of the engaging portion 14a to come into contact with the engaging piece 3f, and a projection 14e extends inwardly from the inner end thereof. The side surfaces of the side plate 14c are stretched to form narrow ear portions 14f, 14f, and a hole 14d is formed in the ear portions 14f, 14f to support the rotary member 6. Reference numeral 15 denotes a coil spring which is disposed between the arm 14 and the stepped portion 3c of the housing member 3, and which urges the arm 14 outwardly. The switch 12 is provided with a terminal plate 12a and an operation rod 12b.

To assemble the illuminated push-button switch of the present invention, first, the lamp 10 is fitted to the hole 9a formed in the bottom of the opening 9b of the cover 9, and the push-button switch 12 having the terminal plate 12a attached is mounted in the switch-mounting chamber 9c so that the operation rod 12b protrudes beyond the chamber 9c. Then, with the projection 3b of the housing member 3 directed upwards, one end of the coil spring 11 is inserted in the recessed portion 3d formed in the stepped portion 3c, and the operation member 4 is inserted in the hole 3a of the housing member 3 in such a manner that the operation arm 3a is opposed to the stepped portion 3c. Further, the return spring 13 is placed around the operation rod 12b of the switch and the cover 9 is mounted to the housing member 3 so that the return spring 13 engages the operation arm 4a. The housing member 3 and the cover 9 are coupled together by screws or by any other suitable means (not shown).

Then, the opening portion 4b of the operation member 4 of the assembly is directed upward, and one end of the coil spring 15 is inserted in the recessed portion 3e that is formed in the stepped portion 3c of the housing member 3. Then, the support shaft 6a of the rotary member 6 is fitted to the engaging holes 14d, 14d formed in the ear portions 14f, 14f of the side plate 14c. The arm 14 is then fitted within the opening 3a of the housing member 3 and attached by snapping the engaging portion 14a into the engaging piece 3f of the housing member 3 in such a manner that the side plate 14c will cover the opening portion 4b' formed in one side of the operation member 4. In this case, the stopper 14b formed at the lower portion of the engaging portion 14a engages with the engaging piece 3f, another end of the coil spring 15 engages with the projection 14e, and the arm is slidably mounted and urged outwards. The display plate 2 is mounted from the inner side of the outer surface 1a of the cap 1, in such a manner that the protruded display portion 2b is fitted to the through hole 1c, and the flat portion 2a is fitted to the recessed portion 1b. The cap 1 which is assembled as above is then so inserted that the display board 2 and the rotary member 6 are opposed to each other above the operation member 4, at such a position that the rotary plate 7 of the rotary member 6 attached to the arm 14 is vertically directed, as shown in FIG. 3. The display plate 2 is then reliably held and supported between the upper inner side of the cap 1 and the upper end of the separator wall 4c of the operation member 4. The switch is thus assembled.

The operation of the illuminated push-button switch of the present invention will be described below.

FIG. 3 shows the state before the switch is operated. The push-button switch is in a returned state (switch is turned off), and the operation rod 12b is in contact with the operation arm 4*a*. Therefore, the operation member 4 has been pushed outwardly against the resilient force of the coil spring 15. The tongue piece 2*c* of the display plate 2 mounted on the cap 1 as a unitary structure is in contact with the rotary plate 7 of the rotary member 6; the rotary plate 7 is in the horizontal position. The display portion 2*b* is located at a position opposed to the rotary plate 8 which is in a vertical position maintaining a distance relative thereto.

Figure 5:
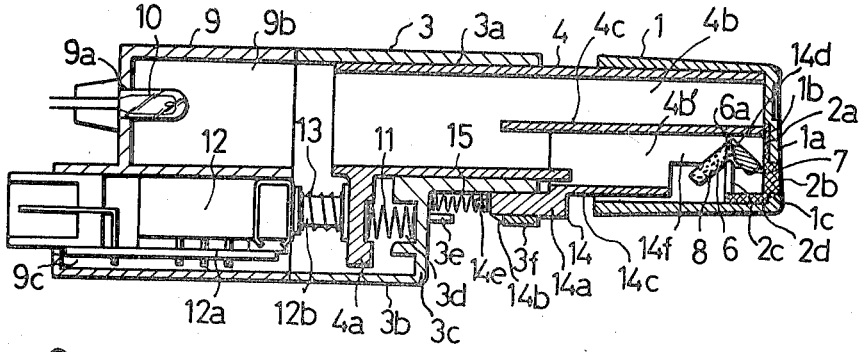
FIGS. 5 to 7 are section views showing major portions when the device of the present invention is operated.
Figure 6:
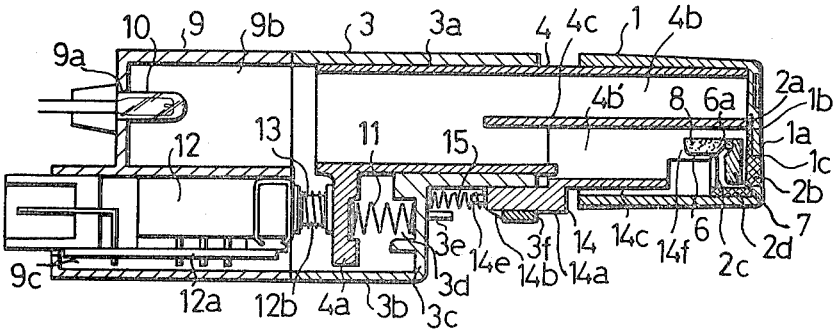

Next, as the cap 1 is depressed, the tongue piece 2*c* which is formed as a unitary structure with the cap 1 comes into contact with the rotary plate 8 that had been located at a vertical position and the rotary member 6 starts to rotate as shown in FIG. 5. As the cap 1 is further depressed, the rotary plate 7 approaches the lower portion of the display portion 2*b* via the state shown in FIG. 5; the rotary plate 7 assumes such a position that it can be seen through the display portion 2*b*. The push-button switch 12 is pushed to a position where it is self-locked and stops at that position (FIG. 6). The push-button switch 12 is switched (turned on). When the cap is further depressed (FIG. 7), the push-button switch 12 is unlocked, and the operation member 4 returns to the initial position being urged by the return spring of the switch 12. During this step, furthermore, the tongue piece 2*c* formed together with the cap 1 as a unitary structure separates away from the rotary plate 8, comes into contact with the rotary plate 7 to rotate the rotary member 6, so that the rotary plates 7, 8 return to their initial positions.

Figure 7:
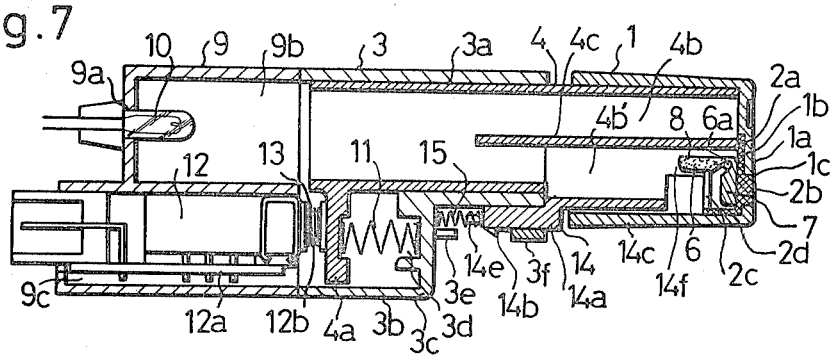

The display portion 2*b* of the cap 1 and the rotary plate 7 should be brought close to each other, as in FIG. 6, so that the display can be easily recognized. To release the lock from the state of FIG. 6 in which the push-button switch 12 is locked, however, the switch 12 must be further pushed as shown in FIG. 7. For this purpose, therefore, extra size is necessary for movement. According to the conventional devices, the display portion 2*b* and the rotary plate 7 could not be brought close enough together. This problem, however, is solved by the present invention in which the arm 14 supporting the rotary member 6 is allowed to move. Namely, referring to FIG. 6, when the cap 1 is pushed to a position at which the display portion 2*b* comes into contact with the rotary member 6 (FIG. 7), the rotary member 6 is depressed. The rotary member 6 is slidably engaged via a coil spring 15 with the housing member 3 to move in the inner and outer directions. Therefore, the rotary member 6 slidably moves together with the cap 1. Since the upper opening portion 4*b* of the operation member 4 is divided by the separator wall and the rotary member 6 is installed in one of the thus divided opening portions, the upper half surface in the upper surface 1*a* of the cap 1 always produces the display being illuminated by the lamp 10, and the lower half surface produces the display depending upon the operation condition of the push-button switch 12 or depending upon the depressed state of the cap 1.

Figure 9:
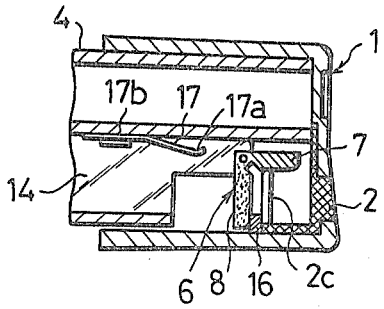
FIG. 9 is a diagram showing the construction of a pressing portion according to another embodiment of the present invention.
Figure 10:
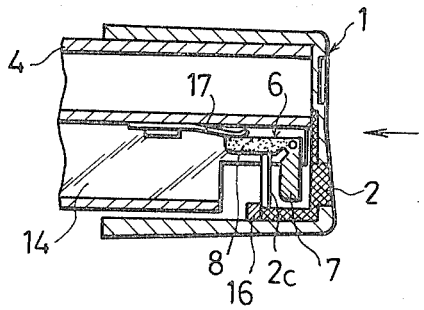
FIGS. 10 and 11 are diagrams illustrating the operation of the embodiment of FIG. 9.

FIG. 9 and subsequent drawings illustrate another embodiment according to the present invention. In the drawings, reference numeral 16 denotes a first resilient piece which is made of a resilient rubber plate and which is disposed at the base portion of the tongue piece 2*c*. When the cap 1 has not been depressed as shown in FIG. 9, the resilient piece 16 is interposed between the tongue piece 2*c* and the surface of the rotary plate 8, whereby the rotary plate 8 is not permitted to tilt, and the light-transmitting rotary plate 7 presses against the tongue piece 2*c*. Reference numeral 17 denotes a second resilient piece made of a slightly folded leaf spring of which one end is secured to the separator wall 4*c* of the operation member 4. When the cap 1 is depressed as shown in FIG. 10, the free end 17*a* of the resilient piece 17 comes into resilient contact with the upper surface of the opaque rotary plate 8; the rotary plate 8 is pressed against the tongue piece 2*c* and is held in a horizontal state.

Namely, according to this embodiment of the present invention, the rotary member 6 is held by the first resilient piece 16 and the tongue piece 2*c* when the cap 1 has not been depressed, and held by the second resilient piece 17 and the tongue piece 2*c* when the cap 1 is depressed. Therefore, the rotary member 6 does not rattle even when vibration is imparted. Further, when the rotary member 6 starts to rotate, the first and second resilient pieces 16, 17 produce resilient forces which assist the rotation of the rotary member 6. Accordingly, the rotary member 6 rotates very smoothly. Further, the display is produced very clearly since the rotary plate 7 or 8 is held in a position strictly parallel with the display board 3 when the cap is depressed or not depressed.

Figure 11:
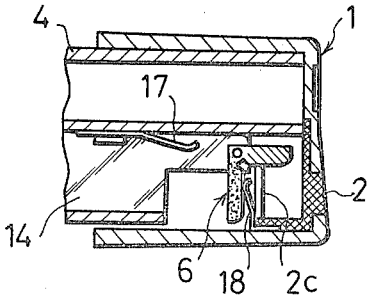

FIG. 11 illustrates a further embodiment of the present invention, in which a spring piece 18 is employed in place of the first rubber piece 16 as in FIG. 9.

Figure 8:
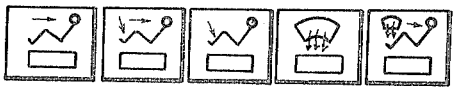
FIG. 8 is a diagram illustrating patterns described on the display boards.

Below is mentioned the case when the present invention is adapted to an operation portion of a device conditioning the air of a car. As shown in FIG. 8, the upper half surface displays the functions by figures, and the lower half surface displays the operation condition being controlled by the push-button switch. Further, the opaque rotary plate 8 of the rotary member 6 works to illuminate the display portion only when the switch is operated. According to the conventional devices in which the color was simply changed to indicate the operation conditions, erroneous operation was often involved. According to the switch of the present invention, however, there is no room for erroneous operation.

With the conventional devices, the display was not discernible when the display portion was illuminated during bright day light hours. In the case of the present invention, on the other hand, the display portion is illuminated and, further, the rotary plate approaches the display portion to produce a mechanical display in addition to the optical display. Therefore, the switch of the present invention produces a very correct and discernible display. According to the conventional devices, furthermore, the lamp must be kept on even during the daylight hours. With the illuminated push-button switch of the present invention, however, the mechanical display can be recognized without turning on the lamp during the daylight hours. Therefore, the switch can be operated without any trouble.

Further, the illuminated push-button switch of the present invention can be so constructed that a plurality of display units are aligned in the same direction and interlocked to each other, in order to obtain correct and easily discernible displays based upon the optical display and the mechanical display.

What is claimed is:

1. An illuminated push-button switch, comprising a housing member receiving a switch actuated by axial movement of an operation portion;

a push-button member disposed slidably within said housing member and having an arm portion engaging said operation portion of said switch for actuation thereof during movement of said push-button within said housing member;

a light source mounted within said housing member;

said push-button member having at its outer end portion a display formed by a plurality of illuminable display elements; and shutter means including a rotatable plate member movable from a position blocking light from one of said display elements during depression of said push-button member to actuate said switch, said shutter means including a tongue portion carried by said push-button member, an opaque plate member, and means including an arm mounted slidably to said push button-member for carrying said shutter means.

2. An illuminated push-button switch, comprising a housing member receiving a switch actuated by axial movement of an operation portion;

a push-button member disposed slidably within said housing member and having an arm portion engaging said operation portion of said switch for actuation thereof during movement of said push-button within said housing member;

a light source mounted within said housing member;

said push-button member having at its outer end portion a display formed by a plurality of illuminable display elements; and shutter means including a rotatable plate member movable from a position blocking light from one of said display elements during depression of said push-button member to actuate said switch, said shutter means including a tongue portion carried by said push-button member and an opaque plate member carried rotatably by an arm mounted slidably to said push-button member;

further including a wall extending inwardly between said display portions.

3. A switch according to claim 1, said plate member being formed by two plate portions connected at right angles and including an opaque plate portion positioned behind said display when said switch is not actuated, and a light transmitting plate portion positioned behind said display when said switch is actuated.

4. A switch according to claim 3, including resilient elements serving to hold said plate portions in position.

* * * * *